United States Patent [19]

Duester et al.

[11] Patent Number: 4,892,237

[45] Date of Patent: Jan. 9, 1990

[54] INTIMATE APPAREL HANGER WITH GARMENT CLAMPING ARMS

[75] Inventors: Everett L. Duester; Russell O. Blanchard; Robert A. Bredeweg, all of Zeeland, Mich.

[73] Assignee: Batts, Inc., Zeeland, Mich.

[21] Appl. No.: 270,271

[22] Filed: Nov. 14, 1988

Related U.S. Application Data

[63] Continuation-in-part of Ser. No. 181,388, Apr. 14, 1988, abandoned, which is a continuation-in-part of Ser. No. 108,227, Oct. 14, 1987, abandoned, which is a continuation-in-part of Ser. No. 49,276, May 13, 1987, abandoned.

[51] Int. Cl.[4] ..... A47G 25/48

[52] U.S. Cl. ..... 223/85; 223/88

[58] Field of Search ..... 223/85, 88, 91, 95, 223/96

[56] References Cited

U.S. PATENT DOCUMENTS

| | | | |
|---|---|---|---|
| 144,679 | 9/1945 | Bolten | 223/88 |
| 3,547,321 | 12/1970 | Crane | 223/88 |
| 4,623,079 | 11/1986 | Tendrup et al. | 223/96 |
| 4,629,102 | 12/1986 | Tendrup et al. | 223/85 |
| 4,828,155 | 5/1989 | Louw | 223/85 |

*Primary Examiner*—Werner H. Schroeder
*Assistant Examiner*—Jodi A. Tokar
*Attorney, Agent, or Firm*—Price, Heneveld, Cooper, DeWitt & Litton

[57] ABSTRACT

A hanger specifically designed for holding and suspending lightweight clothing, particularly delicate fabrics, has a rigid, elongated body terminating at each end in a pair of arms, one on top and one on the bottom of the body forming article receiving slots opening toward the center of the hanger. A third arm creates a downwardly opening slot at the end of the body. The arms are designed to permit limited flexing for seating and removing articles from the slots. The flexing occurs as a hinging action at the point of attachment to the body and at this point the arms are reinforced. The upper of the slots may have a pocket portion for positively securing garment straps and the like and also a finger member spaced from the inner end of the upper arm to form an upwardly opening entry to the slot or it may have a spring-like finger in the pocket which clamps a garment inserted into the pocket area. The downwardly opening end slots may have an upwardly extending finger to clamp a garment against the finger forming the outer side of the slot.

32 Claims, 4 Drawing Sheets

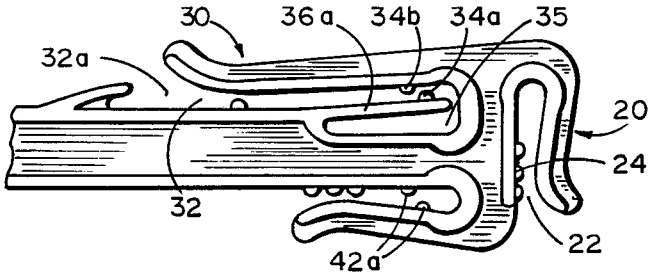
FIG. 7
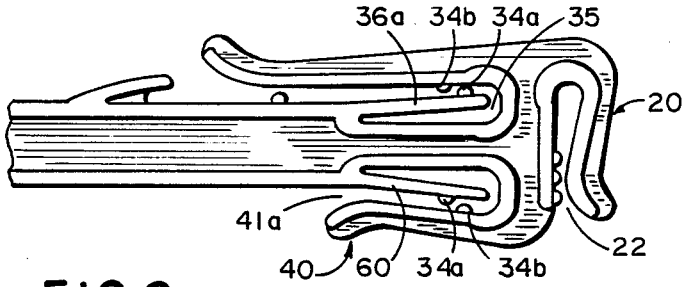
FIG. 8
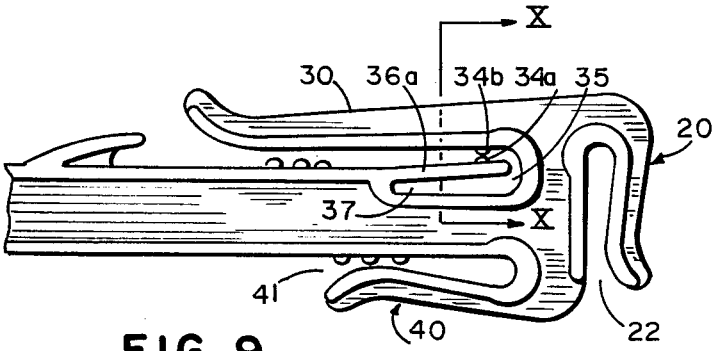
FIG. 9
FIG. 10
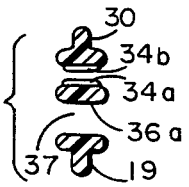

FIG. 14
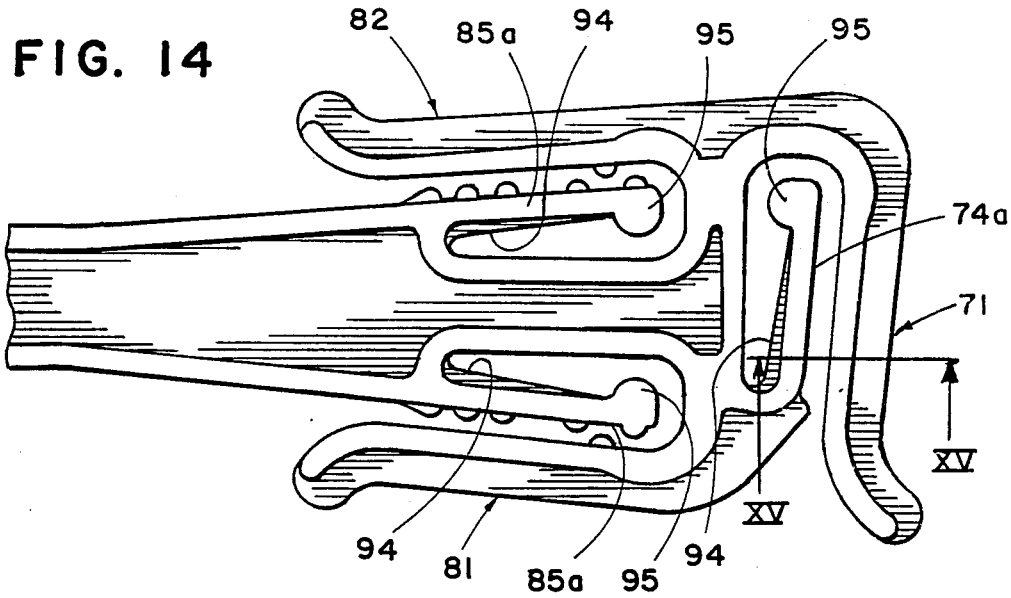
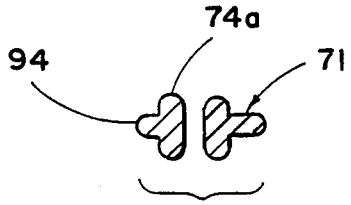
FIG. 15

INTIMATE APPAREL HANGER WITH GARMENT CLAMPING ARMS

FIELD OF THE INVENTION

This application is a continuation-in-part of U.S. patent application Ser. No. 181,388, filed Apr. 14, 1988, now abandoned, entitled INTIMATE APPAREL HANGER WITH GARMENT LOCK which application is a continuation-in-part of U.S. patent application Ser. No. 108,227, filed Oct. 14, 1987, now abandoned, entitled INTIMATE APPAREL HANGER WITH UPPER GARMENT LOCK which application is a continuation-in-part of U.S. patent application Ser. No. 049,276, filed May 13, 1987, entitled INTIMATE APPAREL HANGER, now abandoned.

This invention relates to lightweight, one-piece hangers particularly designed for either display or home use with lightweight delicate garments.

BACKGROUND OF THE INVENTION

For the purpose of effectively displaying lightweight garments of delicate fabrics, such as underwear and the like, there is a need for a hanger which will effectively and reliably hold the garment for the purpose of display without damage to the delicate fabrics involved. The hanger must also be capable of effectively gripping various types of garments. It is equally desirable to provide such a hanger which can be repeatedly used with the garments by the user without damage or wear on the garment itself. This is particularly true in connection with laundering the garments. Because of the nature of the garments with which these types of hangers are used, it is important that the hangers themselves be lightweight, easy to use and capable of gripping the garment without the use of means which would cut or injure any of the threads of the garment. It is also important that the hanger be inexpensive because, in the case of many retail facilities, the hangers either have a single use or, in some cases, are delivered to the customer with the hanger. From the viewpoint of the customer, particularly one who travels, it is important that the hanger be lightweight, capable of being tightly packed in luggage and transportable with a minimum of required spaced.

This invention provides an improvement over the hanger disclosed in U.S. Pat. No. 4,623,079, issued Nov. 18, 1987, to D. Tendrup et al. entitled GARMENT HANGER WITH GRIP and U.S. Pat. No. 4,629,102, issued Dec. 16, 1986, to D. Tendrup et al., entitled GARMENT HANGER WITH CLIP. The invention provides a garment hanger from which can be suspended a variety of garments, such as underwear, brassieres, slips or pantyhose, these being only exemplary of the broad spectrum of use of the invention. The invention is particularly designed to provide a positive support for garments suspended from their straps which will assure that the straps will not become detached and, thereby, release the garment. The invention also provides the capability of hanging garments having wide support bands, as well as narrow support bands. The invention provides security means for this type of garment which positively prevents inadvertent release of the garment by the hanger because the hanger's construction necessitates the positive intervention of an operator to effect garment release. The construction of the arms which clamp the garment to the hanger is such that the arms can be flexed many times without danger of breakage due to fatigue and yet the arms provide sufficient resistance to deflection to effectively and positively clamp the garment.

BRIEF DESCRIPTION OF THE DRAWINGS

FIG. 7 is an enlarged, fragmentary front view of a modified construction for the hanger;

FIG. 8 is an enlarged, fragmentary front view of a further modified construction for the hanger;

FIG. 9 is an enlarged, fragmentary front view of a still further modified construction for the hanger;

FIG. 10 is a sectional elevation view taken along the plane X—X of FIG. 9;

FIG. 14 is an enlarged, fragmentary front view of another modification of this invention; and FIG. 15 is a sectional view taken along the plane XV—XV of FIG. 14.

DESCRIPTION OF THE PREFERRED EMBODIMENT

Figure 5:
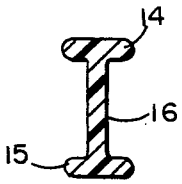
FIG. 5 is an enlarged, sectional view taken along the plane V—V of FIG. 1.

The numeral 10 refers to a hanger having an elongated body 11 and an upstanding hook 12. The hook is centered midway between the ends of the body 11 and preferably is integral with the body. Preferably, the body and the hook and all structure which is integral with both is molded of a suitable plastic as a single, integral unit. Suitable plastics for this purpose include polyethylene and polypropylene. As best seen in FIG. 5, to obtain maximum strength with minimum material, the body 11 is shaped as an I-beam with upper and lower flanges 14 and 15 connected by a vertical web 16.

The hook 12 is provided with a panel 17 for attachment of a size indicator. This type of panel and the size indicator system used with such panel is described in U.S. Pat. No. 4,450,639, entitled HANGER WITH SIZE INDICATOR PANEL, issued May 29, 1984, to Everett L. Duester.

Figure 1:
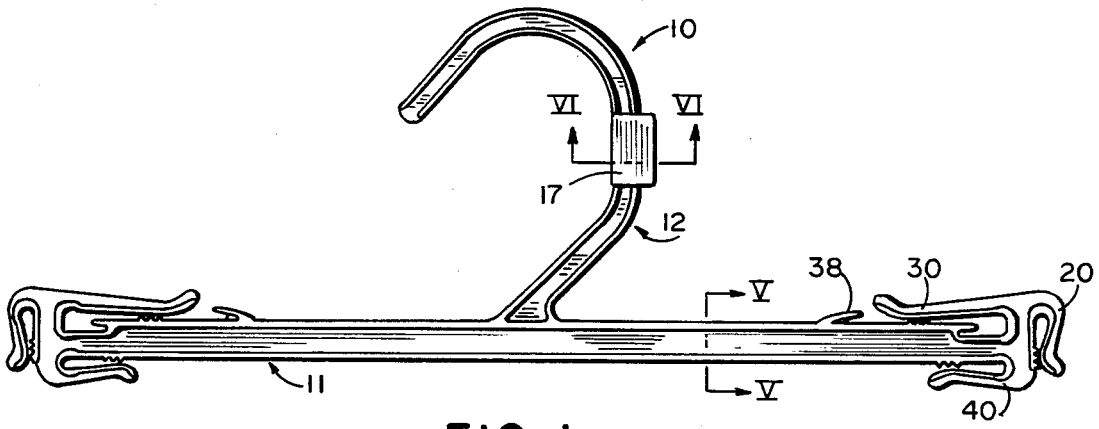
FIG. 1 is a front elevation view of a hanger incorporating this invention.
Figure 2:
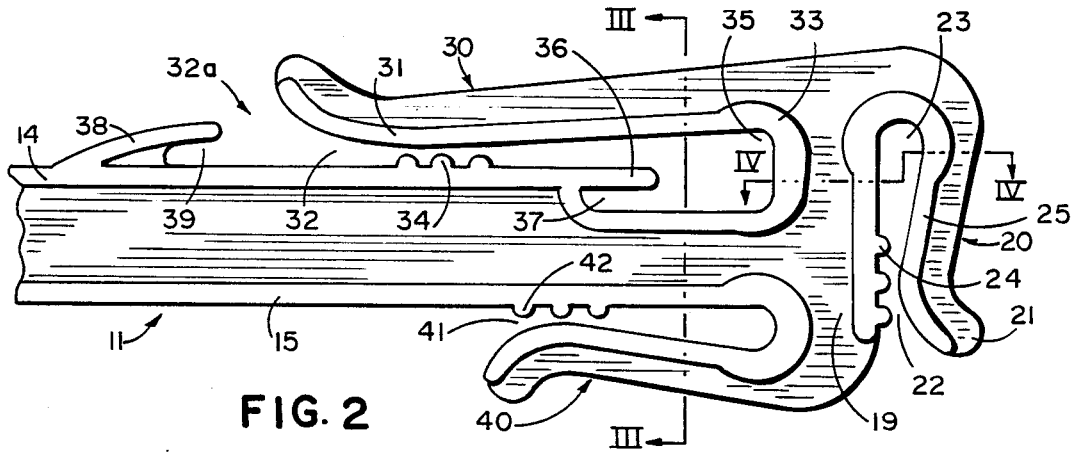
FIG. 2 is an enlarged, fragmentary, front view of one end of the hanger.
Figure 4:
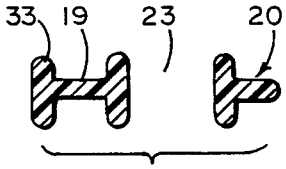
FIG. 4 is a sectional view taken along the plane IV—IV of FIG. 2.
Figure 6:
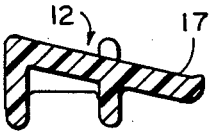
FIG. 6 is an enlarged, sectional view taken along the plane VI—VI of FIG. 1.

The opposite ends of the body 11 are identical and each is designed to provide multiple means for engaging and supporting garments. Since the ends are identical, the description of one end will be considered to apply equally to the opposite end of the body. Referring now specifically to FIG. 2, it will be seen that the body terminates in a vertical web portion 19 from the top of which an arm 20 extends outwardly and downwardly to an outwardly curved end portion 21. The arm 20 forms a garment receiving slot or channel 22 which is open at its lower end. The shape of the arm 20 is such that the mouth or open end of the slot 22 is narrower than the upper or inner end 23, thus, providing a garment clamping zone. In addition, the surface of the body facing into the slot 22 is provided with a plurality of spaced projections or protrusions 24 which serve as grips for garments inserted into the slot 22 and pressed against the protrusions by the arm 20. The protrusions are smoothly rounded so that they will not cut or snag the delicate fabrics of the garments with which the hanger is designed to be used. It will be seen from FIG. 2 that the web 16 of the body is reinforced adjacent the slot 22 by a front to back extending flange 25. This flange is reinforced by a portion of the web which is integral with the outer face of the flange, forming an arm of T-shaped cross section. It will also be noted from both FIGS. 2 and 4 that that portion of the flange which extends around the closed end of the slot 22 is thickened to improve its structural characteristics and to provide additional resistance to flexing. This structure is particularly important in providing the portion connecting the arm to the body itself with both the resilient but relatively stiff characteristics necessary to create an effective garment grip and also to provide the necessary resistance to fatigue resulting from the frequent flexing. This latter is a serious problem with molded plastic products which require a part of the body of the molded product to be repeatedly flexed, particularly when the area in which the bending is to occur cannot be molded of a plastic which is particularly suited to flexing because of the need for relatively high resistance to flexing. Also, the thickened flange is reinforced by the outwardly extending web which provides substantial support and resistance to the joint as well as durability and strength.

The vertical portion 19 of the end of the body 11 from which the arm 20 extends has an inwardly extending portion forming an upper arm 30. The upper arm 30, like the outer arm 20, has a cross flange 31 at its inner face which is an extension of the upper flange 14. The flange 31 extends around and defines the slot 32 formed between the upper arm 30 and the upper face of the body 11. Again, the flange 31, where it passes around the blind end or outer end of the slot 32 is increased in thickness to provide the same type of resistance to flexing as is provided for the arm 20 and also serving the same purpose.

Like the slot 22, the slot 32 is narrowed adjacent its open end and in the narrow portion is provided with a plurality of protrusions 34 identical to the protrusions 24. Outwardly, from the protrusions 34 and adjacent the blind end of the slot 32, the slot is deepened to form a pocket 35 which is recessed downwardly into the body 11. At the entrance to the pocket, the upper flange 14 of the body is extended outwardly a short distance into the pocket 35 to provide a tongue 36 overlying a recess 37.

Spaced inwardly a short distance from the upwardly turned inner end of the upper arm 30, a finger 38 extends upwardly and outwardly at an angle from the upper flange 14 of the body 11. The outer end of the finger extends over a recess 39 between it and the upper flange 11. The outer end of the finger 38 in cooperation with the inner end of the upper arm 30 defines a restricted upwardly opening entrance **32*a* to the slot 32. This particular arrangement is effective in positively preventing unintentional release of garments secured by having a strap or the like seated in the slot from becoming detached from the hanger. This is in addition to the fact that the tongue 36** is also an effective restraint against accidental garment release.

Also, extending from the end of the arm 11 is a lower finger 40 defining a slot 41 between it and the lower flange 15 of the body. The slot 41, for all practical purposes, is identical to the slot 22, except that it extends horizontally and its blind end is toward the outer end of the body 11. It also has a plurality of protrusions 42 narrowing the entrance to the slot as well as the thickened portion of the flange in the hinge area where the arm joins the body. Both of the fingers 30 and 40 are stiffened and reinforced by the rib-like extensions of the web 16 extending outwardly from the slots 32 and 41, respectively.

By providing the three different slots, two or which extend lengthwise of the beam and one vertically, the hanger is equipped to handle a wide variety of garments. Because the hinge areas where the arms join the body 11 are thickened and reinforced, the fatigue failure which has been experienced in hangers of this construction in the past has been eliminated. Further, the stiffness of the hinge is increased and, therefore, the hangers are successful in effectively gripping garments manufactured of materials which provide surfaces having low friction surface characteristics, thus, materially reducing the chance that a garment will be unintentionally released.

The construction of the upper arm with the upwardly opening entrance to the slot is particularly desirable as a means of securing the support of garments which are of a fabric having a slick or low friction surface or may be of a nature such that they cause the hanger to tilt about its center hook creating a tendency to allow at least one side of the garment to be released from the pocket in which it is mounted. This will positively not occur in the case of this construction because the garment has to move upwardly, rather than simply laterally, to escape the confines of the pockets 35. With the reinforced construction of the arms 20, 30 and 40, the garment clamping and holding effectiveness of the hanger is materially increased.

Figure 3:
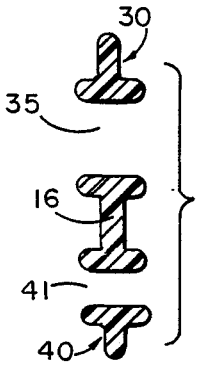
FIG. 3 is a sectional, elevation view taken along the plane III—III of FIG. 2.

FIGS. 7–10 illustrate modifications of the hanger construction described above. In each case, the arms forming the slots remain the same cross-sectional design as the corresponding arms shown in FIGS. 3 and 4. In each of the modified constructions, the tongue **36*a* has been lengthened to prevent the garment from entering the lower portion of the pocket 35. Also, protrusions or projections 34*a* have been added to the upper surface of the tongue 36*a* adjacent its free end and a projection 34*b* has been added to the lower surface of the flange 31. As illustrated in FIGS. 7 and 8, the projections 34*a* and b are offset from each other lengthwise of the tongue but in the construction illustrated in FIG. 9 they are vertically aligned. When they are offset, as in FIGS. 7 and 8**, they can be and preferably do vertically overlap.

In the construction illustrated in FIG. 7, additional projections **42*a* have been added to the walls of the slot 41**.

In the construction illustrated in FIG. 8, the slot **41*a* has been modified to be similar to the pocket 35 and a tongue 60 similar to the tongue 36*a* is added. The tongues 36*a* and 60 are resilient and, by reason of their length, act in the manner of a leaf spring. Thus, they cause the projections 34*a*** and *b* to grip the garments, further anchoring them against unintended release. Since the garments have not been passed around a projection into a recess having a partially closed entrance, removal of the garments is facilitated because they do not have to be lifted and passed around the guard or tongue as is the case with the construction illustrated in FIG. 2. At the same time, construction provides a positive guard against accidental release.

Figure 11:
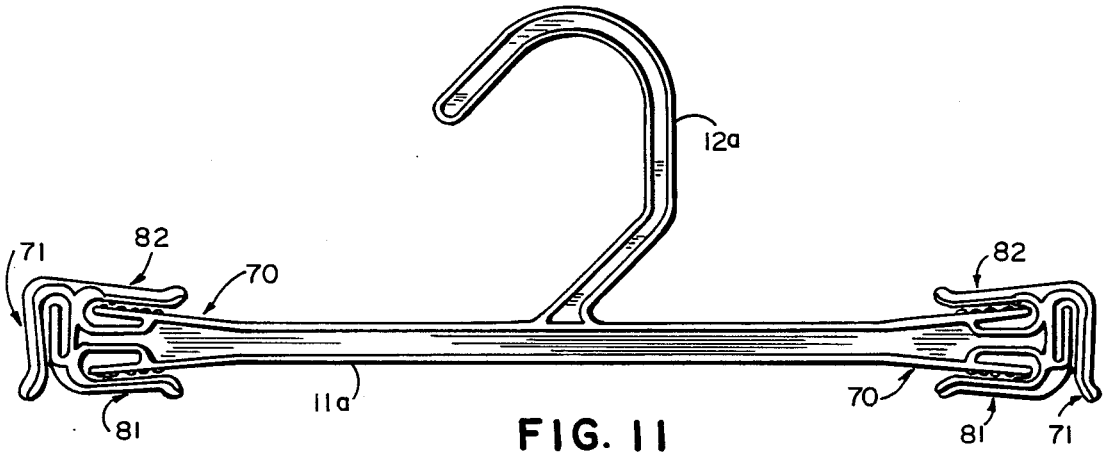
FIG. 11 is a front elevation view of an additional modification of the invention.
Figure 12:
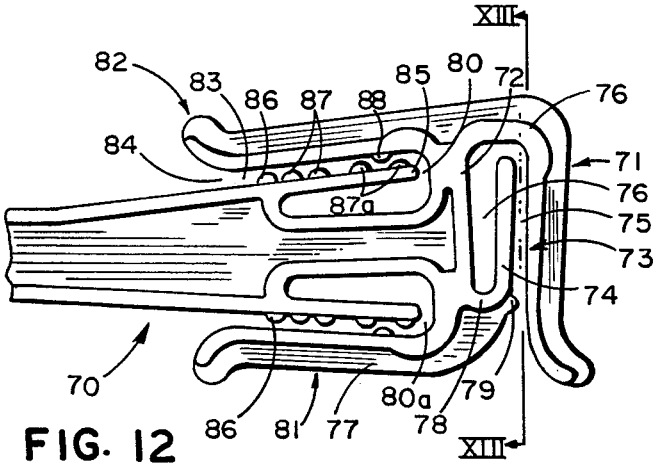
FIG. 12 is an enlarged fragmentary front elevation view of one end of, the hanger illustrated in FIG. 11.
Figure 13:
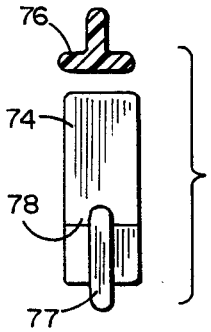
FIG. 13 is a sectional elevation view taken along the plane XIII—XIII of FIG. 12.

FIGS. 11–13 illustrate another modification of the hanger's construction. In this construction, the body 11a is similar in cross section to the body 11 and is supported at its center by a hook 12a. The hook 12a is the same as hook 12 except it is illustrated as modified by elimination of the panel 17. The body 11a, like the body 11, has an I-beam type of cross section, such as illustrated in FIG. 5. However, its ends 70 are vertically enlarged. This enlargement makes it possible to provide end clamps having greater vertical depth and, thus, more frictional contact with a garment. This also provides the hanger with the ability to handle a wider range of garment constructions, particularly those having wide waistbands.

As is best seen in FIG. 12, at each end of the body, the arm 71 extends downwardly. The arm is spaced outwardly from the end wall 72 of the body to form a generally vertical slot-like pocket 73, open at the bottom and closed at the top. The lower end of the arm 71 is curved outwardly to provide a guide when garments are being mounted on the hanger. The lower edge of the body extends partially across the lower end of the pocket 73 providing a nexus 78 which supports an upwardly extending finger 74, the upper end of which is adjacent to but detached from the closed end of the pocket 73. The finger 74 divides the pocket into a relatively narrow garment receiving channel 75 between the finger 74 and the arm 71 and a wider chamber 76 between the arm 71 and the end wall 72 of the hanger body. The chamber 76 provides a space into which the finger can be deflected by a garment inserted into the channel 75. The finger 74 is as wide as the flange 76 which extends around the pocket 73 (FIG. 13). Preferably, the pocket 73 is wider at the top than at the bottom to provide the upper end of the finger adequate deflection room. The thickness of the finger is such as to resist deflection but not so great that it will not deflect before the necessary tension applied by the garment will cause injury to the garment or make use of the hanger difficult. The vertical member 77 of the arm which forms the lower horizontal clamp 81 extends under the nexus 78 supporting the finger 74 and provides strength and support for the base of the arm where it is joined to the end of the hanger body. Also, the laterally outer end of this flange extends into the entrance of the channel 75 providing a smoothly rounded projection 79 serving as a positive restriction. This serves the dual purpose of assuring the application of positive clamping pressure against the garment to hold it in the channel 75 and provide a ledge to seat under any hem or similar band at the top of the garment to further support it. Also, by so extending around the nexus supporting the finger, it further stiffens and strengthens it.

Horizontally extending garment clamps are provided on both the top and the bottom of the hanger adjacent the pocket 73. These clamps are identical except for the fact that the lower pocket 80a is inverted with respect to the upper pocket 80. The upper pocket 80 is formed by an arm 82 which extends inwardly along the top of the hanger body forming an article receiving slot 83 between it and the top of the hanger body. Access to the slot is through the opening 84 between the hanger body and the curved end of the arm 82.

The pocket widens vertically and is divided by a tongue 85 which extends in cantilever fashion almost the entire length of the pocket. The outer end of the tongue 85 is spaced from the end wall of the pocket and above the bottom of the pocket whereby the tongue has space to deflect under pressure from a garment inserted in the slot 83.

Within the slot, the top of the tongue 85 forming the bottom of the slot 83 has a plurality of upwardly extending protrusions arranged in two groups. The first protrusion 86 adjacent the entrance to the slot is wedge shaped having an elongated, inclined surface facing the entrance to the slot to facilitate the introduction of garments into the slot. Four additional protrusions 87 and 87a, arranged in pairs, are provided. The protrusions 87a are spaced further apart than the protrusions 87 creating a gap above which a protrusion 88 extending downwardly from arm 82 is provided to form an article grip. The slot formed by the lower arm 81 has the same pattern of protrusions. The protrusions 87, 87a and 88 have the same construction as the protrusions 34a and *b* illustrated in FIG. 10.

The fact that the arms 71, 81 and 82 are all T-shaped in cross section is important. This construction not only provides the arms with the degree of resistance to deflection necessary to effectively grip and hold the garments it also strengthens the joinder of the arms to the hanger body. This is important in eliminating breakage of this type of arm construction which has been experienced in the use of hangers which have this type of garment grip.

FIGS. 14 and 15 illustrate a further refinement of the invention. The only changes introduced into that illustrated in FIGS. 11–13 relate to the tongue or finger in the vertical end pocket and the tongue or fingers in the upper and lower pockets. In this construction, the finger 74a is reinforced by a central rib 94 which extends from the base of the finger or its nexus to the body a major portion of the finger's length. The height of the rib from the surface of the finger tapers with the height being greatest at the base of the finger and gradually tapering to nothing toward the finger's free end.

The finger 74a is also provided with an enlarged head 95 at its free end which extends into the deflection chamber. The head 95 acts as a stop to limit deflection, thus, if necessary, requiring the clothes situated in the garment channel to deflect the intermediate portion of the finger, if additional space is required. This provides a very positive grip on the garments. The tongues or fingers 85a in the pockets 80 and 80a are constructed the same way and function in the same manner.

Having described the preferred embodiments of our invention and certain modifications thereof, it will be understood that additional embodiments can be made without departing from the principles thereof. Such embodiments are to be considered as included in the hereinafter appended claims, unless these claims by their language, expressly state otherwise.

We claim:

1. A garment hanger having an elongated body and supporting hook means midway between the ends of said body, the opposite ends of said body being identical and each comprising: a first arm at the body's outer end spaced from and overlying the top of and integral with said body, said arm forming a garment receiving first slot between the arm and the body; an upwardly and outwardly inclined finger having an outer end spaced from the inner end of said arm for defining an upwardly opening entrance to said slot; a downwardly extending second arm at the end of the body integral with the body at its upper end, said second arm forming a downwardly opening second garment receiving slot; a third arm extending toward the center of said body adjacent the lower edge of said body, said third arm being integral with the end of said body and forming a third garment receiving slot extending along the body's lower edge; the entrances to said slots formed by said first, second and third slots each being narrower than the inner portions of said slots to cause clamping of garments seated in said slots.

2. A garment hanger as described in claim 1 wherein a tongue is provided in the inner portion of said first slot, the inner end of said tongue being integral with said body and the outer end extending substantially to the outer end of said first slot, said tongue being spaced from both the upper and lower surfaces of said first slot and being resilient for clamping a garment seated between it and the upper surface of said first slot.

3. A garment hanger as described in claim 1 wherein a tongue is provided in the inner portion of said third slot, the inner end of said tongue being integral with said body and the outer end extending substantially to the outer end of said third slot; said tongue being spaced from both the upper and lower surfaces of said third slot and being resilient for clamping a garment seated between it and the lower surface of said slot.

4. A garment hanger as described in claim 3 wherein projections are provided on both of said tongues adjacent their free ends and on the lower surfaces of said slots and being adjacent each other and creating a garment trapping passage between them.

5. A garment hanger as described in claim 1 wherein a tongue is provided in the inner portion of said first and third slots, the inner end of each said tongue being integral with said body and the outer end extending substantially to the outer ends of said first and third slots; said tongue being spaced from both the upper and lower surfaces of said slots and being resilient for clamping a garment seated between it and the upper surface of said first slot and the lower surface of said third slot.

6. A garment hanger having an elongated body and supporting hook means midway between the ends of said body, the opposite ends of said body being identical and each comprising: a first arm at the body's outer end and spaced from and overlying the top of and integral with said body at the end thereof adjacent the end of said body, said first arm forming a receiving slot between said first arm and said body; the outer end of said slot being enlarged downwardly to form a garment holding pocket recessed into said body adjacent the end of said first arm integral with said body; said pocket at its entrance having a tongue extending outwardly of said body into said pocket and spaced from the bottom of said pocket for dividing said pocket into upper and lower portions and providing a restricted entrance to the lower portion of said pocket, a plurality of upstanding projections on the upper surface of said body in said slot and directed toward said arm for partially closing said slot; said body having a second arm, said second arm extending toward the center of said body adjacent the lower edge of said body and forming a garment receiving slot along the body's lower edge, the outer end of said second arm being integral with said body; a downwardly extending third arm integral with said body at its upper end with the end of said body and forming a downwardly opening garment receiving slot, the entrances to said slots to cause clamping of garments seated in the slots.

7. The garment hanger described in claim 1 wherein a depending projection is provided on said first arm, said projection being offset from the projections on said body lengthwise of the pocket.

8. The garment hanger described in claim 1 wherein a depending projection is provided on said first arm, said projection being vertically aligned with a projection on said body.

9. A garment hanger having an elongated body and support means extending upwardly therefrom, the opposite ends of said body being identical and each comprising: a downwardly extending arm at the body's outer end, said arm being spaced from the end wall of said body, said arm forming a vertically extending pocket between the arm and the body; a finger integral with said body at its lower end and extending upwardly within said pocket in spaced relationship to said end wall and dividing said pocket into a garment receiving channel open at its lower end and an elongated deflection chamber adjacent said end wall, said deflection chamber being closed at its lower end, the upper end of said finger being spaced from the upper end of said pocket whereby said finger can be deflected into said deflection chamber by a garment inserted into said channel, means at the entrance to said channel extending partially across said entrance and restricting the width thereof for positively gripping an article inserted into said channel, said finger being resiliently resistant to deflection to firmly press against an article inserted into said channel.

10. A garment hanger as described in claim 9 wherein said deflection chamber is wedge shaped, being wider at the top than at the bottom.

11. A garment hanger as described in claim 10 wherein a nexus is provided at the lower end of said finger for connecting said finger to said end wall, said body having a dependent reinforcement flange integral with said nexus to support said finger, the outer end of said flange forming said entrance restricting means.

12. A garment hanger having an elongated body and support means extending upwardly therefrom, the opposite ends of said body being identical and each comprising: a generally horizontally and inwardly extending arm adjacent the body's outer end, said arm being spaced from the upper edge of said body, said arm forming a generally horizontally extending pocket between the arm and the top of the body; a finger spaced from both the top of said body and the bottom face of said arm and extending outwardly into said pocket and dividing said pocket into a garment receiving channel adjacent said arm and an enlongated deflection chamber below said finger, the outer end of said finger being spaced from the outer end of said pocket whereby said finger can be deflected downwardly into said chamber by a garment inserted into said channel, a plurality of first garment gripping means projecting upwardly from the upper surface of said finger into said channel and second garment gripping means projecting downwardly from the lower surface of said arm between at least a pair of said first gripping means for positively securing a garment inserted into said channel, said finger being resiliently resistant to deflection to firmly press against a garment inserted into said channel.

13. A garment hanger as described in claim 12 wherein the surfaces of said gripping means are rounded whereby fabrics may be passed over them without snagging.

14. A garment hanger as described in claim 13 wherein the gripping means adjacent the entrance to said channel has an inclined surface facing said entrance forming a garment ramp to facilitate insertion of a garment into the channel.

15. A garment hanger as described in claim 12 wherein a horizontal arm and a pocket formed thereby are provided along the lower edge of said body below each of arms at the top of said body, each of the pockets formed thereby having a tongue and garment gripping means of identical construction to that at the top of the hanger body.

16. A garment hanger having an elongated body and support means extending upwardly therefrom, the opposite ends of said body being identical and each comprising: a downwardly extending arm at the body's outer end, said arm being spaced from the end wall of said body, said arm forming a vertically extending pocket between the arm and the body; a first finger spaced from both said end wall and said arm extending upwardly within said pocket and dividing said pocket into a garment receiving channel open at its lower end and an elongated deflection chamber adjacent said end wall and closed at its lower end, the lower end of said first finger being integral with said body and the upper end of said first finger being spaced from the upper end of said pocket whereby said first finger can be deflected into said chamber by a garment inserted into said channel, means at the entrance to said channel extending partially across said entrance and restricting the width thereof for positively gripping a garment inserted in said channel, said first finger being resiliently resistant to deflection to firmly press against a garment inserted into said channel; a generally horizontally and inwardly extending second arm adjacent to and integral with the body's outer end, said second arm being spaced from the upper edge of said body, said second arm forming a generally horizontally extending second pocket between the second arm and the top of the body; a second finger spaced from both the top of said body and the bottom face of said second arm extending outwardly into said second pocket and dividing said pocket into a garment receiving channel adjacent said arm and an elongated deflection chamber below said second finger, the outer end of said second finger being spaced from the outer end of said second pocket whereby said second finger can be deflected downwardly into said chamber by a garment inserted into said channel, a plurality of first garment gripping means projecting upwardly from the upper surface of said second finger into said channel and second garment gripping means projecting downwardly from the lower surface of said second arm between at least a pair of said first gripping means for positively securing a garment inserted into said channel, said second finger being resiliently resistant to deflection to firmly press against a garment inserted into said channel.

17. A garment hanger as described in claim 16 wherein a nexus is provided at the lower end of said first finger for connecting said first finger to said end wall, said body having a dependent reinforcing flange integral with said nexus to support said first finger, the outer end of said flange forming said entrance restricting means.

18. A garment hanger as described in claim 16 wherein each of said first and second arms are T-shaped in cross section having an outwardly extending flange, said flange providing both a crack and fatigue resistant reinforcement and a stiffener for the juncture of said arms to said body.

19. A garment hanger as described in claim 2 wherein a stiffening web is centered between the sides of the tongue in said first slot, said web projecting from the tongue into that portion of the slot into which the tongue would be deflected by the presence of a garment in said first slot.

20. A garment hanger as described in claim 19 wherein the stiffening web is tapered with its greatest thickness normal to the tongue and at the base of the tongue.

21. A garment hanger as described in claim 20 wherein the tongue has a stop element at its free end extending in the same direction as the stiffening web for limiting deflection of the tongue by a garment inserted into said first slot.

22. A garment hanger having an elongated body and support means extending upwardly therefrom, the opposite ends of said body being identical and each comprising: a downwardly extending arm at the body's outer end, said arm being spaced from the end wall of said body, said arm forming a vertically extending pocket between the arm and the body; a finger spaced from both said end wall and said arm extending upwardly within said pocket and dividing said pocket into a garment receiving channel open at its lower end and an elongated deflection chamber adjacent said end wall, said chamber being closed at its lower end, the upper end of said finger being spaced from both walls of the pocket and the upper end of the pocket whereby said finger can be deflected into said chamber by a garment inserted into said channel, means at the entrance to said channel extending partially across said entrance and restricting the width thereof for positively gripping a garment inserted into said channel, said finger having a reinforcement rib integral with the side thereof facing said end wall, said rib extending a major portion of the length of the finger from the lower end thereof for stiffening said finger against deflection, said finger as reinforced by said rib being resiliently resistant to deflection to firmly press against a garment inserted into said channel.

23. A garment hanger as described in claim 22 wherein said rib is tapered lengthwise with its greatest dimension adjacent the juncture of the finger with the hanger body.

24. A garment hanger as described in claim 23 wherein said finger has a stop element on its free end extending into said chamber for limiting deflection of the tongue by a garment inserted in the garment receiving channel.

25. A garment hanger as described in claim 24 wherein said pocket at its entrance has a flange extending outwardly from the lower end of said finger into the entrance to said pocket to partially close the open end of said pocket for gripping a garment inserted into said pocket.

26. A garment hanger having an elongated body and support means extending upwardly therefrom, the opposite ends of said body being identical and each comprising: a downwardly extending arm at the body's outer end, said arm being spaced from the end wall of said body, said arm forming a vertically extending end pocket between the arm and the body said pocket being blind at its upper end, said pocket opening at its lower end; upper and lower horizontal arms each forming a blind pocket opening toward the center of the hanger;

all of said pockets having a finger therein the free end of which is adjacent the blind end of the pocket; each of said fingers being integral the hanger body at its end opposite from its free end and each finger dividing the pocket into which it is located in a garment receiving channel adjacent the arm and a deflection chamber adjacent the face of the finger opposite from the arm; means at the entrance to each of the channels extending partially across said entrance to restrict the width thereof for positively gripping a garment inserted in the channel; each of said fingers having a stop element on its free end extending into said deflection chamber for limiting deflection of said finger.

27. A garment hanger as described in claim 26 wherein rib means are provided in each of said deflection chambers integral with a finger forming the chamber for stiffening the finger against deflection.

28. A garment hanger as described in claim 27 wherein said rib means is tapered with its greatest thickness adjacent the juncture of the finger with the hanger body.

29. A garment hanger as described in claim 26 wherein each of said arms is "T-shaped" in cross section being reinforced by a central outwardly extending flange.

30. A garment hanger as described in claim 26 wherein the entrance restricting means for said upper and lower pockets is a gripper member having an inclined surface facing toward the center of the hanger forming a ramp to facilitate insertion of a garment into the channel.

31. A garment hanger as described in claim 26 wherein the fingers in each of said pockets formed by said upper and lower arms have a plurality of rounded gripping means integral therewith projecting into the channel formed by the finger, said gripping means being spaced apart lengthwise of the fingers.

32. A garment hanger as described in claim 31 wherein a gripping means of like construction is also provided on the arm forming each of said upper and lower pockets; said gripping means projecting into the channel between a pair of gripping means on the finger forming the channel.

* * * * *

UNITED STATES PATENT AND TRADEMARK OFFICE

CERTIFICATE OF CORRECTION

PATENT NO. : 4,892,237

DATED : January 9, 1990

INVENTOR(S) : Everett L. Duester et al.

It is certified that error appears in the above-identified patent and that said Letters Patent is hereby corrected as shown below:

Column 7, line 67:

After "said slots" insert -- formed by said first, second and third arms being substantially narrower than the inner portions of said slots --

Signed and Sealed this

Twenty-sixth Day of April, 1994

*Attest:*

*Attesting Officer*

Bruce Lehman

BRUCE LEHMAN

*Commissioner of Patents and Trademarks*